US012758061B2

(12) United States Patent
Ostfeld et al.

(10) Patent No.: US 12,758,061 B2
(45) Date of Patent: Oct. 13, 2026

(54) HYGIENIC TOILET ACCESSORY

(71) Applicant: HELPEETECH LTD, Hadera (IL)

(72) Inventors: Zur Ostfeld, Hadera (IL); Oz Ostfeld, Kiryat Ono (IL)

(73) Assignee: HELPEETECH LTD, Hadera (IL)

( * ) Notice: Subject to any disclaimer, the term of this patent is extended or adjusted under 35 U.S.C. 154(b) by 114 days.

(21) Appl. No.: 18/841,755

(22) PCT Filed: Mar. 9, 2023

(86) PCT No.: PCT/IL2023/050247
§ 371 (c)(1),
(2) Date: Aug. 27, 2024

(87) PCT Pub. No.: WO2023/181020
PCT Pub. Date: Sep. 28, 2023

(65) Prior Publication Data

US 2025/0169662 A1 May 29, 2025

(30) Foreign Application Priority Data

Mar. 20, 2022 (IL) ..... 291511

(51) Int. Cl.
*A47K 13/16* (2006.01)
*A47K 13/30* (2006.01)

(52) U.S. Cl.
CPC ..... *A47K 13/165* (2013.01); *A47K 13/302* (2013.01)

(58) Field of Classification Search
CPC ..... A47K 11/105; A47K 13/225; A47K 13/24–242; A47K 13/28; A47K 13/30–302; A47K 17/003; E03D 9/002
See application file for complete search history.

(56) References Cited

U.S. PATENT DOCUMENTS 1,346,311 A * 7/1920 Friedrich ..... A47K 13/302 4/233
3,961,386 A * 6/1976 Beno ..... A47K 13/225 4/243.3

(Continued)

FOREIGN PATENT DOCUMENTS

CN 109662636 * 4/2019 ..... A47K 13/302
CN 111387864 * 7/2020 ..... A47K 13/28

(Continued)

OTHER PUBLICATIONS

Kampf et al. "Persistence of coronaviruses on inanimate surfaces and their inactivation with biocidal agents" Journal of Hospital Infection 104 pp. 346-251. (2020). doi: 10.1016/j.jhin.2020.06.001. PMID: 32035997; PMCID: PMC7132493.

(Continued)

*Primary Examiner* — David P Angwin
*Assistant Examiner* — Nicholas A Ros
(74) *Attorney, Agent, or Firm* — The Roy Gross Law Firm, LLC; Roy D. Gross

(57) ABSTRACT

A hygienic toilet accessory comprises a hollow housing member which is attachable to a toilet related element and which is configured with an elongated slit, and a toilet isolating sheet which is intermittently extendable through and retractable into said slit and which has a weighted distal edge, said sheet dimensioned to completely cover a central opening of a toilet seat when extended to an extreme position and to prevent discharge of aerosols from the toilet underlying therebelow.

34 Claims, 10 Drawing Sheets

(56) References Cited

U.S. PATENT DOCUMENTS

| | | | | | |
|---|---|---|---|---|---|
| 4,713,845 | A | * | 12/1987 | Bono | A47K 13/302 4/233 |
| 5,454,123 | A | * | 10/1995 | Barabino | E03D 9/002 4/662 |
| 2011/0258763 | A1 | | 10/2011 | Freeman | |
| 2018/0035852 | A1 | | 2/2018 | Cao et al. | |

FOREIGN PATENT DOCUMENTS

| | | | | | |
|---|---|---|---|---|---|
| KR | 100593391 | B1 | | 6/2006 | |
| KR | 200436813 | | * | 10/2007 | A47K 13/28 |
| KR | 200439117 | | * | 3/2008 | A47K 13/10 |
| KR | 200439117 | Y1 | | 3/2008 | |
| KR | 20110010319 | A | | 2/2011 | |
| KR | 20130129332 | A | | 11/2013 | |
| KR | 101347922 | B1 | | 1/2014 | |

OTHER PUBLICATIONS

PCT International Search Report for International Application No. PCT/IL2023/050247, mailed Apr. 30, 2023, 3pp.
PCT Written Opinion for International Application No. PCT/IL2023/050247, mailed Apr. 30, 2023, 4pp.

* cited by examiner

HYGIENIC TOILET ACCESSORY

CROSS REFERENCE TO RELATED APPLICATIONS

This application is a National Phase of PCT Patent Application No. PCT/IL2023/050247 having International filing date of Mar. 9, 2023, which claims the benefit of priority of Israeli Patent Application No. 291511, filed Mar. 20, 2022, the contents of which are all incorporated herein by reference in their entirety.

FIELD OF THE INVENTION

The present invention relates to the field of hygienic promoting devices. More particularly, the invention relates to a hygienic toilet accessory.

BACKGROUND OF THE INVENTION

A toilet fixture is at constant risk of exposure to unsanitary sources resulting from human waste, and the risk of transmitting bacteria is high when a user touches any surface of the toilet, for example a toilet seat or lid, particularly one that is soiled by urine droplets.

Another health risk in a bathroom setting is that many viruses are spread through fecal particles. For example, hepatitis A often passes through food that has been treated by people who have not been careful to wash their hands after visiting the toilet. The New York Times reported on Aug. 12, 2020 the discovery of genetic material of the severe acute respiratory syndrome coronavirus 2 (SARS-COV-2) in the feces of patients. Concerns were thus raised that the coronavirus could be found in tiny water droplets (aerosols) in toilets. Researchers recommended closing the toilet lid before flushing, to prevent scattering of the aerosols located at the bottom of the toilet bowl. A study reported by CNN on Jun. 16, 2020 has found that toilet water splashes to great heights and spreads throughout the bathroom space. Public toilets can thus be a source of infection for the coronavirus, as well as for other viruses and bacteria. Most public toilets are usually not equipped with toilet seat covers, and urinals are not covered.

The common practice of preventing the spread of viruses and bacteria at a public bathroom by covering the toilet seat with toilet paper is very wasteful of toilet paper and of global resources needed to produce the toilet paper. One study has revealed that over 700 million trees, a trillion tons of water and 70 million tons of oil are needed to produce the 42 million tons of toilet paper that are used annually worldwide. A reduction in use of toilet paper will therefore have a major impact on the environment.

Many people are careful not to contact a toilet seat. In addition to the repulsion of many toilet users to the presence of urine droplets on a toilet seat, the toilet seat at times constitutes a source of the coronavirus. As described above, the coronavirus disperses in the air as a result of a flushing operation and then settles on exposed surfaces including on top of a toilet seat. Kampf et al, "Persistence of Coronaviruses on Inanimate Surfaces and their Inactivation with Biocidal Agents", J. Hosp. Infect. 2020, states that human coronaviruses can persist for up to 9 days at room temperature. Thus toilet users are liable to contract the coronavirus and become infected by touching a toilet seat on which are located viral particles and then touching the mouth, nose, or eyes.

Standard hygienic and cleaning protocols are recommended to reduce the viral load present on toilet seats. The World Health Organization (WHO) advises frequent, correct and consistent disinfection and cleaning procedures of environments and touched surfaces, which must be thoroughly cleaned with water and simple disinfectants. Cleaning procedures remove large numbers of microorganisms from surfaces and should always precede disinfection, which is a less lethal anti-microbial process than sterilization. Routine cleaning and disinfection can achieve the removal and elimination of the main pathogenic microorganisms, although not necessarily of all microbial forms. However, such protocols are considerably time consuming, imposing high manpower loads during the cleaning of public toilet facilities.

It is an object of the present invention to provide a hygienic toilet accessory that prevents a toilet user from being infected with bacteria or viruses upon accessing the toilet.

It is an additional object of the present invention to provide a hygienic toilet accessory that prevents access to the toilet if not properly sanitized, even if a cover is not provided.

It is an additional object of the present invention to provide a hygienic toilet accessory that obviates the need of covering a toilet seat with toilet paper in order to ensure a sanitary bathroom environment.

It is yet an additional object of the present invention to provide a hygienic toilet accessory that helps to reduce the time needed to clean a toilet seat.

Other objects and advantages of the invention will become apparent as the description proceeds.

SUMMARY OF THE INVENTION

A hygienic toilet accessory comprises a hollow housing member which is attachable to a toilet related element and which is configured with an elongated slit, and a toilet isolating sheet which is intermittently extendable through and retractable into said slit and which has a weighted distal edge, said sheet dimensioned to completely cover a central opening of a toilet seat when extended to an extreme position and to prevent discharge of aerosols from the toilet underlying therebelow.

In one aspect, the weighted edge comprises a sanitization assembly attached to a distal region of the sheet, said sanitization assembly comprising means for sanitizing the toilet seat during extension or retraction of the sheet, or during extension and retraction of the sheet.

In one aspect, the accessory further comprises means for automatically displacing the toilet isolating sheet. The automatic displacing means is configured to set the toilet isolating sheet to a default fully extended position.

A toilet seat configured to cooperate with a toilet isolating sheet comprises vertically spaced and aligned upper and lower layers to define therebetween an interspace within which a linearly displaceable sheet is guidable to an extreme distal region of said toilet seat to isolate an underlying toilet and to prevent discharge of aerosols from the underlying toilet, wherein each of said upper and lower layers is formed with a central opening to facilitate use of the underlying toilet, and wherein said upper and lower layers are completely unattached at an inner edge thereof adjoining said central opening to accommodate linear displacement of the sheet.

A method for sanitizing a toilet seat comprises the steps of providing a motor driven post about which is wound a toilet isolating sheet and a sanitization assembly attached to a distal region of said sheet, detecting, by signal generating detection apparatus, presence of a user who has accessed a toilet, in response to said detected presence, transmitting a trigger signal from said detection apparatus to a communication module in data communication with a driver of said motor, and activating said motor in response to transmission of said trigger signal, to cause said sheet to be linearly displaced relative to an underlying toilet seat and said sanitization assembly to sanitize the underlying toilet seat.

A hands-free and sanitizing-promoting toilet-interfacing system comprises a mat in which is embedded an array of pressure sensitive sensors; a communication module in short-range data communication with, and configured to process a signal transmitted by, each of said sensors to determine whether a front or a back of the user is facing a toilet upon stepping on said mat; and a toilet-interfacing component in data communication with said communication module, wherein said communication module is configured to activate said component following determination of a toilet facing position of the user.

In one aspect, an air freshener is embedded in the mat, said air freshener comprising a foot engageable actuator which is also embedded the said mat and which is configured to cause, when engaged, emission of a fragrance.

DETAILED DESCRIPTION OF THE INVENTION

The transmission of the coronavirus and of other viruses and bacteria in a bathroom environment following a flushing operation is mitigated or altogether eliminated by means of a hygienic toilet accessory that ejects a toilet bowl isolating sheet, which in one embodiment is guided along a predetermined path, before the toilet is accessed. The toilet bowl isolating sheet thus inwardly deflects virus bearing aerosols that would normally be discharged from the toilet bowl into the bathroom surroundings. This accessory also sanitizes the toilet seat as the toilet bowl isolating sheet is ejected.

Figure 1:
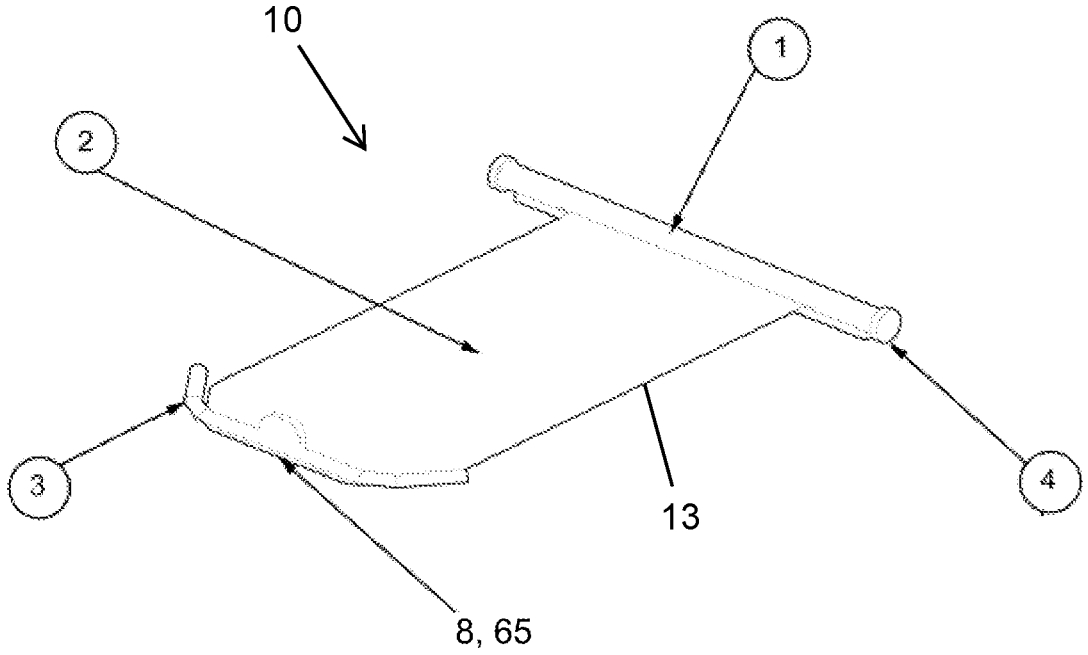
FIG. 1 is a perspective view from the top of an embodiment of a hygienic toilet accessory, shown when the toilet isolating sheet is in a fully extended position.
Figure 2:
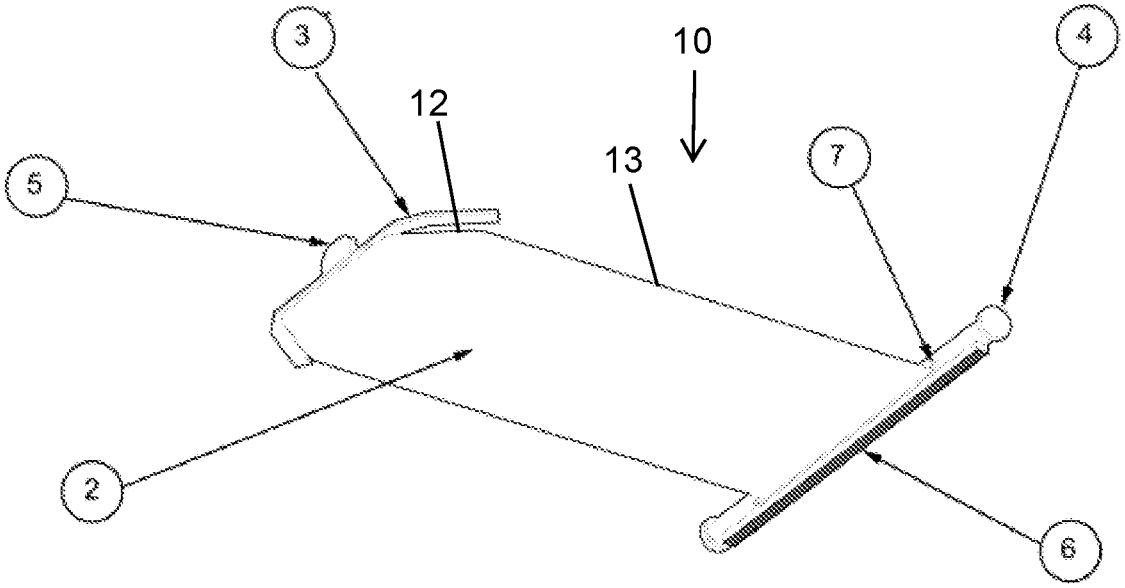
FIG. 2 is a perspective view from the bottom of the hygienic toilet accessory of FIG. 1, shown when the toilet isolating sheet is in a fully extended position.

FIGS. 1 and 2 illustrate a hygienic toilet accessory, generally indicated as 10, according to one embodiment. In this embodiment, accessory 10 is used to upgrade an existing toilet seat so as to promote an improved hygienic environment.

Accessory 10 comprises a hollow cylindrical housing 1 to which is attached and within an inner cavity of which is storable, when retracted, a toilet isolating sheet 2. Sheet 2 is adapted to extend through a longitudinal slot 7 formed in cylindrical housing 1. Cylindrical housing 1 may be adhesively and securely attached, such as by a releasable adhesive strip 6 applied to a bottom region of the outer surface of the housing, to an upper surface of a toilet seat proximate to a hinge assembly that facilitates pivoting of the toilet seat relative to the toilet bowl. It will be appreciated that housing 1 may assume other exterior shapes as well.

Sheet 2, which is generally reusable, is rectangular, or of any other desired shape, and is sized to entirely cover the toilet seat opening, and usually the entire toilet seat, when completely extended. At the distal edge, i.e. an edge at a furthermost distance from cylinder housing 1, of sheet 2 is attached a wiper assembly 8. Sheet 2 is made of a material that is sufficiently flexible so as to be able to be rolled within cylindrical housing 1, yet has sufficient structural strength to support wiper assembly 8 when the sheet is completely extended without collapsing through the toilet seat opening. Sheet 2 is preferably washable in order to be reused if soiled.

Wiper assembly 8 has a central attachment element, such as of uniform thickness, which extends along the distal edge of sheet 2 and is securely attached thereto, for example by welding. The attachment element made of a sturdy and lightweight material, such as a polymeric foam, e.g. polypropylene foam. A tab 5 protruding vertically from the attachment element is used to guide sheet 2 when being extended or retracted. Wiper assembly 8 is able to direct sheet 2 during a sheet extending operation until being engaged with an outer edge of the toilet seat.

Extending obliquely from each transversal end of the attachment element, and unattached to an oblique edge 12 of the sheet 2 which extends to a side edge 13 thereof, is a corresponding elongated wiper 3, which is generally made of elastomeric material. The oblique orientation of a wiper 3 ensures that a majority, or the entire, surface of a toilet seat surrounding the central opening will be contacted by a wiper during a wiping action, both when the sheet is extended and retracted, without requiring the wiper to inconveniently protrude from a transversally short region of the toilet seat. A cleaning agent may be applied to the toilet seat prior to a sheet extending operation, or alternatively the liquid cleaning agent may be contained with an interior of a wiper 3 and discharged through a hole formed in an outer wiper surface, possibly in response to the manual actuation of a pressable button.

A stationary post to which the proximal edge of sheet 2 is irreleasably attached is positioned within the interior cavity of cylindrical housing 1. Each longitudinal end of the post may be connected to a corresponding knob 4 which is mounted on an end of the cylindrical wall of housing 1. Sheet 2 is urged to roll about the post when being retracted, such as by means of tab 5. When sheet 2 is retracted to a fullest extent, each wiper 3 which is separated from oblique sheet edge 12 may be urged to contact the outer surface of cylindrical housing 1 and to be plastically deformed so as to be collinear with the attachment element of wiper assembly 8. A roller in contact with the rolling sheet, or other tensioning means well known to those skilled in the art, may also be mounted within cylindrical housing 1.

A spring may be attached to the post to which sheet 2 is attached and be biased, such as with a time delay, to ensure that sheet 2 will be extended outwardly through slot 7 after being momentarily retracted. If for some reason sheet 2 is not retracted or extended as desired, the sheet movement may be carried out by rotating the two knobs 4 in the desired direction.

Cylindrical housing 1 may be provided with other means, such as mechanical, electric or electromechanical means, for ensuring that sheet 2 will be fully extended when a user accesses the toilet whose opening is covered by the sheet.

The ability of sheet 2 to be extended and to cover the toilet seat opening promotes toilet seat cleanliness and a sanitary toilet environment. A male user seeing the extended sheet 2 when the toilet seat opening is covered thereby is reminded to lift the toilet seat rather than urinating when the toilet seat is lowered and risking the soiling of the toilet seat. The male use often realizes the utility of the extended sheet and lowers the toilet seat after urination so that the extended sheet will inwardly deflect any virus bearing aerosols that are liable to be discharged from the toilet bowl during a flushing operation. Suitable instructions for male users may be posted on a bathroom wall.

If for some reason the male user chose not to lift the toilet seat, he is urged to retract sheet 2 with tab 5 in order to uncover the toilet seat opening prior to urination. When accessory 10 is spring loaded, sheet 2 will be subsequently urged to the extended position. In this fashion, the toilet seat is able to become cleaned and disinfected by wiper assembly 8 every time the sheet becomes extended or retracted.

Accessory 10 may also be implemented for use with respect to a urinal.

As wide-area toilet isolating sheet 2 is set in an extended position for a prolonged period of time, it is able to constitute revenue generating advertising space. Sheet 2 may be configured with one or more exterior protective layers that are transparent or translucent, for example liquid impermeable lamination layers, or configured in other ways to facilitate reuse of the sheet without deterioration. A cleaning agent such as a disinfectant may be received within cylinder housing 1, so that sheet 2 will be applied with the cleaning agent upon being retracted into the cylinder housing.

FIGS. 3-6 illustrate a hygienic toilet accessory, generally indicated as 20, according to another embodiment. In this embodiment, accessory 20 comprises, in addition to the features of accessory 10, a clip-on toilet seat 24 that is superimposed upon, and coupled to, the existing toilet seat. Cylindrical housing 25, provided with knobs 4, from which toilet isolating sheet 2 and the attached wiper assembly 8 and vertically protruding tab 5 extends is of sufficiently low profile so as not to interfere with the toilet bowl or with a toilet seat lid when the toilet seat is being pivoted.

Figure 3:
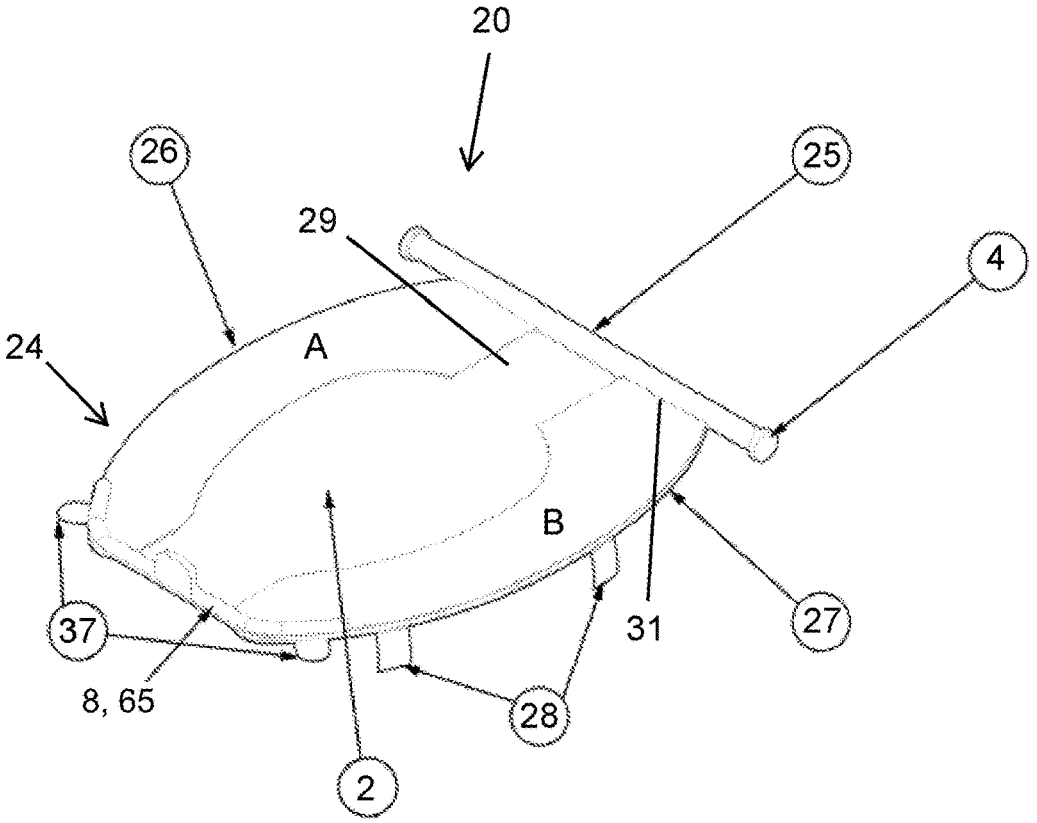
FIG. 3 is a perspective view from the top of another embodiment of a hygienic toilet accessory, shown when the toilet isolating sheet is in a fully extended position.
Figure 4:
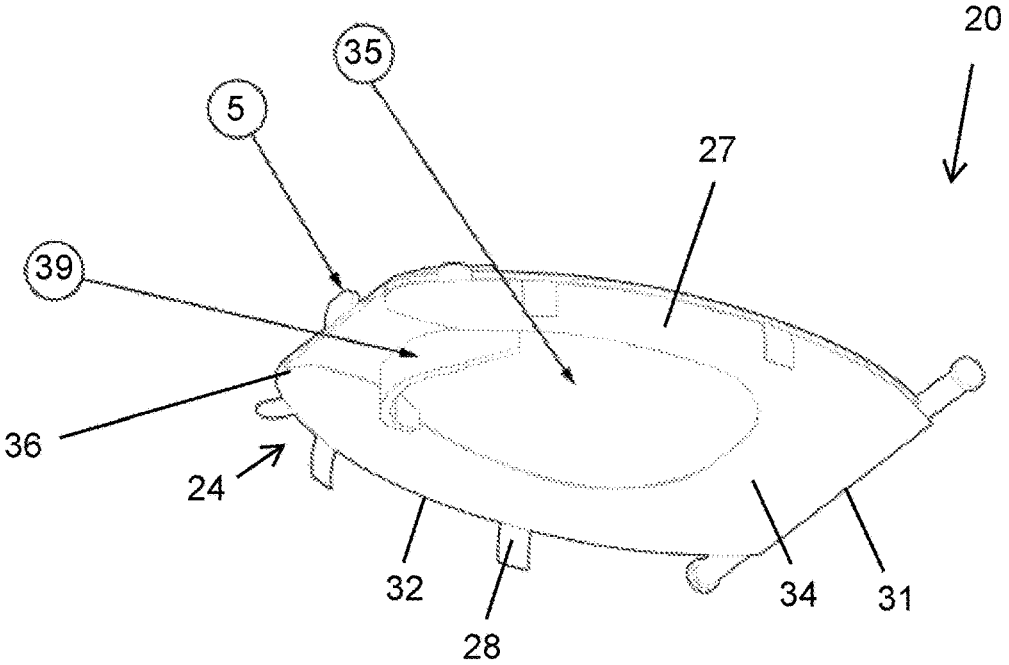
FIG. 4 is a perspective view from the bottom of the hygienic toilet accessory of FIG. 3, shown when the toilet isolating sheet is in a fully extended position.

As shown in FIGS. 3 and 4, clip-on toilet seat 24 may be configured with two rigid and mutually parallel layers 26 and 27. The upper layer 26 is adapted to be contacted by a user while sitting and the lower layer 27 is adapted to be in abutting relation with the existing toilet seat. Upper layer 26 is configured with separated C-shaped, or otherwise concave, sections A and B, which may be of mirror symmetry, to provide therebetween a passageway 29 from a proximal region 31 configured with a straight edge which is in abutting relation with cylindrical housing 25, such as being integrally formed therewith or connected thereto, for example releasably connected thereto, to a curved distal region 36 of clip-on toilet seat 24, along which the attachment element of the wiper assembly is able to be displaced unrestrictedly. Passageway 29 overlies, and is in communication with, the central opening of the existing toilet seat.

A plurality of fastening clips 28 extend outwardly from a different region of the outer edge 32 of lower layer 27 and are adapted to secure clip-on toilet seat 24 to the existing toilet seat. When each clip 28 is an elongated and flexible element, as illustrated, it is adapted to be wrapped around, and secured to, a corresponding peripheral region of the existing toilet seat. A clip 28 may also be a spring clip, fixedly attached to lower layer 27, or separable therefrom, or any other releasable attachment means well known to those skilled in the art such as a suction cup.

While upper layer 26 is constructed from two separated sections A and B, lower layer 27 may be made from a single U-shaped section that is aligned with, and is of the same size as, sections A and B of the upper layer. The U-shaped section including a proximal boundary element 34 extending to the straight edge provided at proximal region 31 and underlying passageway 29 delimits the oval opening 35 of lower layer 27 that is aligned with the central oval opening of the existing toilet seat. Lower layer 27 may be configured with an opening at the distal region to prevent genitals from contacting the toilet seat and to minimize urine splatter.

Placement of clip-on toilet seat 24 on the existing toilet seat and removal therefrom may be assisted with two lifting tabs 37 of limited length, which may be horizontally oriented and extend from the outer edge 32 of lower layer 27 close to a corresponding distal region 36 of the U-shaped section. Lifting tabs 37 are generally germ free as they extend outwardly from the toilet seat and are therefore not exposed to urine splatter. Protection against urine splatter may also be afforded by an arcuate urine shield 39 that is positioned within a distal area of opening 35 that is slightly proximal to the distal regions 36 and extends between two legs of the U-shaped section. Urine shield 39 may be integrally formed with lower layer 27 or releasably coupled therewith.

Figure 5:
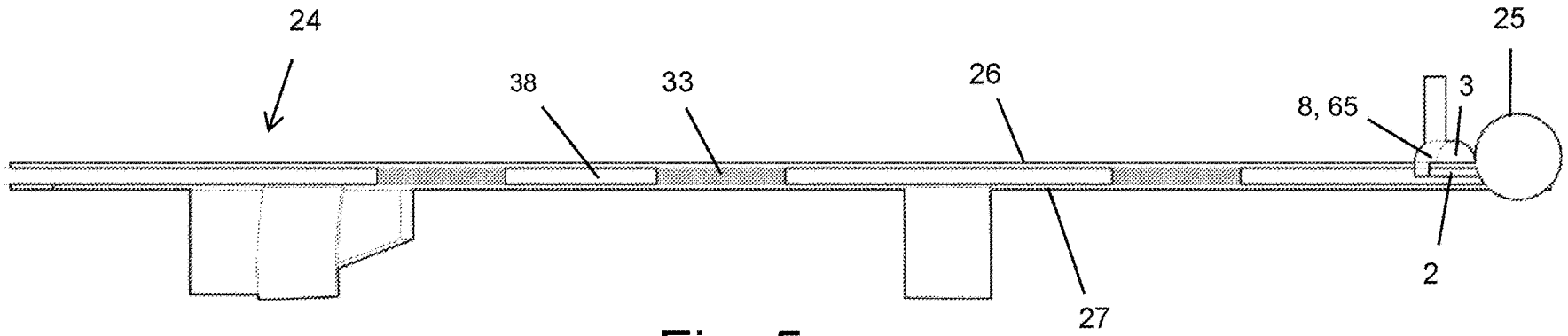
FIG. 5 is a side view of the hygienic toilet accessory of FIG. 3, shown when the toilet isolating sheet is in a fully retracted position.

As shown in FIG. 5, the two layers 26 and 27 define an intervening interspace 38 therebetween, and are interconnected or integrally formed together by a plurality of spacers 33 extending from vertically aligned outer regions of the two layers, i.e. regions that are located away from passageway 29 (FIG. 3), to form a monolithic clip-on toilet seat 24. Alternatively, a continuous spacer interconnecting or integrally formed with layers 26 and 27 is provided at vertically aligned outer regions of the two layers. Cylindrical housing 25 is integrally formed with the proximal region of the upper and lower layers, or alternatively positioned in close proximity thereto, and therefore toilet isolating sheet 2 is able to be irreleasably received within the interspace 37 and to be reliably guided between the upper and lower layers during sheet extending and retracting operations. Wiper assembly 8 is shown to be attached to the distal edge of sheet 2, and a wiper 3 thereof is shown to be in movable engagement with upper layer 26.

If so desired, upper layer 26 and lower layer 27 need not be mutually parallel, but rather the interspace 37 therebetween may have a varying dimension. That is, each of the spacers 33 may have a different height, causing the planar upper and lower layers to be angularly spaced one from the other and the dimension of the interspace to be different at different distances from cylindrical housing 25. Alternatively, lower layer 27 need not be completely planar, but rather portions thereof may be angularly spaced one from the other, allowing interspace 37 to have a varying dimension at different distances from cylindrical housing 25.

In one embodiment, each spacer 33 may be configured with compressible material, so that when a user sits on upper layer 26 of toilet seat 24, the spacers 33 become compressed and the dimension of interspace 37 is reduced. As a result of the reduced dimension of the interspace between upper layer 26 and lower layer 27, which may be varying as described above, sheet 2 becomes clamped by upper layer 26 and is prevented from being extended through the interspace despite the tendency of the spring-influenced sheet 2 to be displaced in a distal direction. In this fashion, the user is assured of not being contacted by wiper assembly 8 when sitting on toilet seat 24.

Figure 6C:
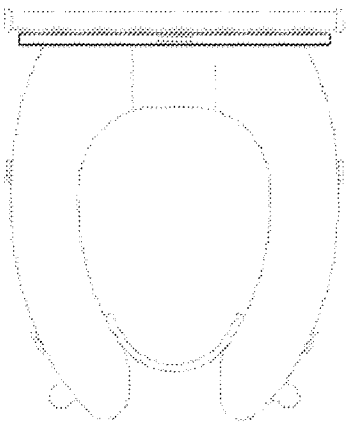
FIGS. 6A-C are a top view of the hygienic toilet accessory of FIG. 3, shown when the toilet isolating sheet is in a fully extended position, an intermediate position, and a fully retracted position, respectively.
Figure 6B:
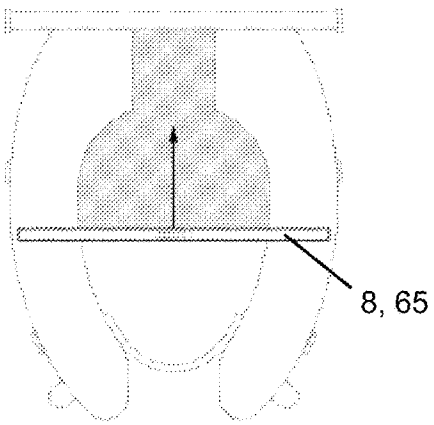
Figure 6A:
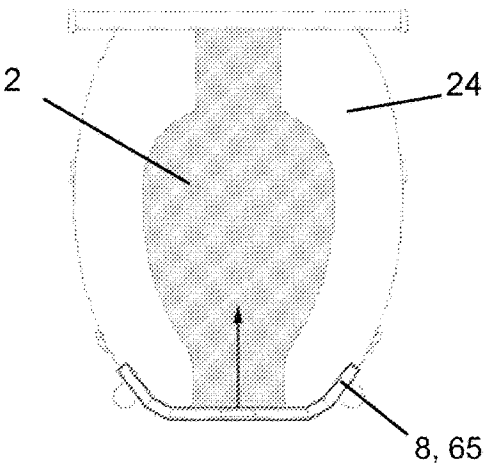

FIGS. 6A-C illustrate wiper assembly 8, which is attached to sheet 2, when positioned at fully extended, intermediate and retracted positions, respectively, with respect to clip-on toilet seat 24.

Figure 7:
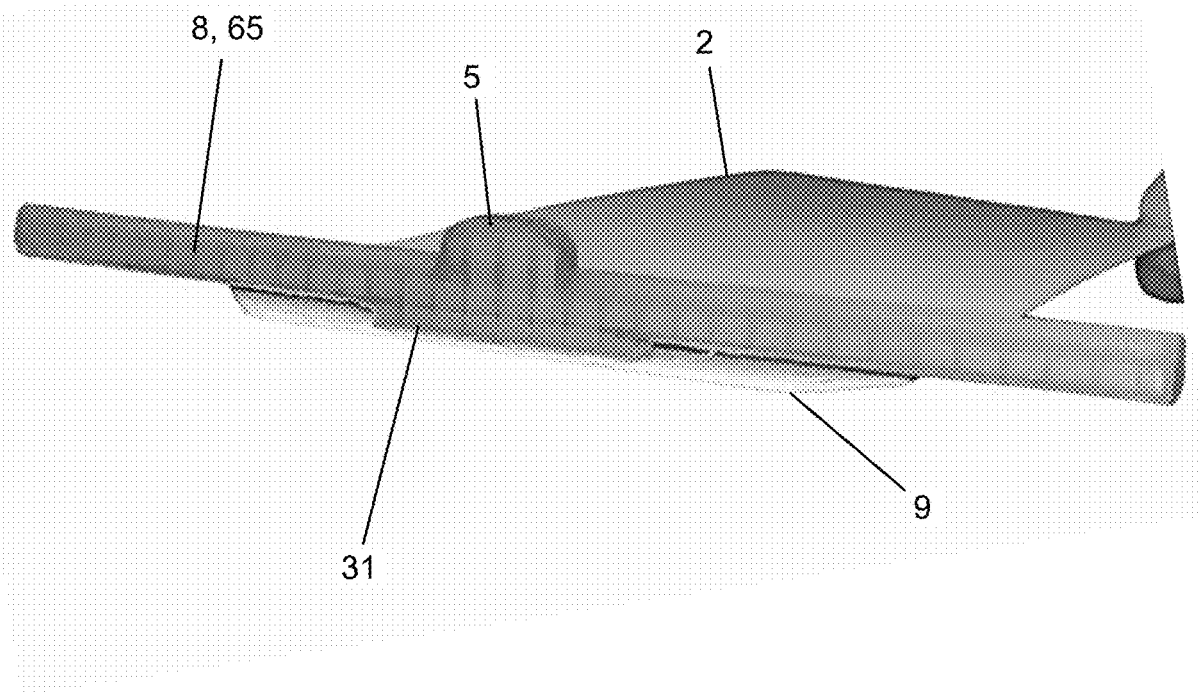
FIG. 7 is a front view of an attachment element by which a wiper assembly is attached to a toilet isolating sheet.

Even though sheet 2 is guided through the interspace, the wiper assembly 8 is advantageously able to sanitize the vertically spaced upper layer by means of the vertically oriented attachment element 31 shown in FIG. 7. Attachment element 31 is attached to a central region of sheet 2, such as by welding, adhesion, by being integrally formed therewith, or by any other attachment means well known to those skilled in the art, close to, or at, the distal edge 9 thereof, and is sufficiently sturdy to support each elongated arm of the wiper assembly 8. By the provision of attachment element 31, wiper assembly 8 is able to be vertically separated from sheet 2 by a distance greater than or equal to the thickness of the upper layer and to be in movable engagement with the upper layer of the clip-on toilet seat. Attachment element 31 is narrower than the width of the passageway of the clip-on toilet seat and is therefore able to be displaced uninhibitedly therethrough. Tab 5 may be integral with attachment element 31 and vertically protrude from wiper assembly 8.

Figure 8:
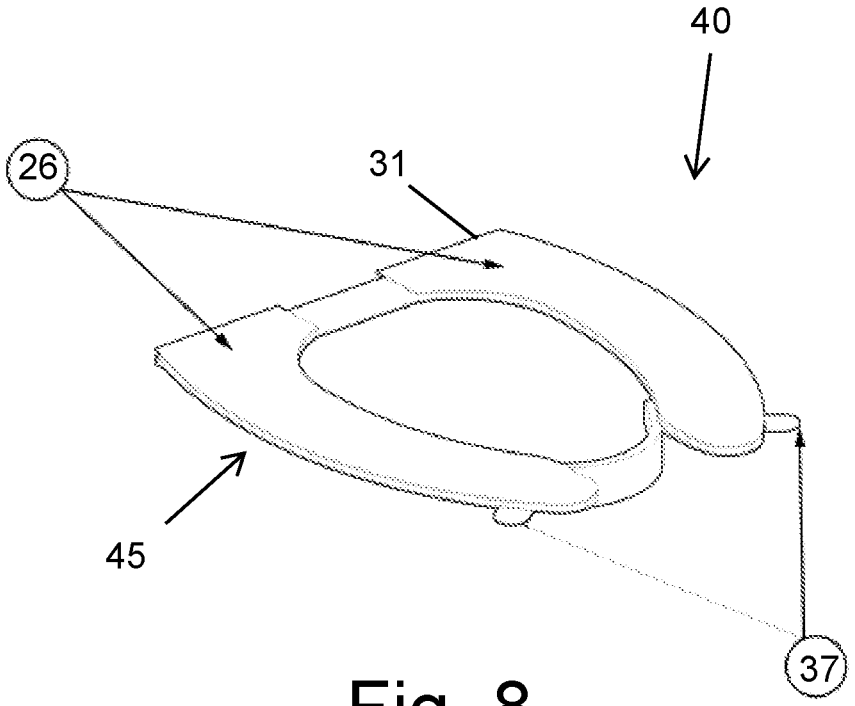
FIG. 8 is a perspective view from the top of a toilet seat, according to one embodiment.
Figure 9:
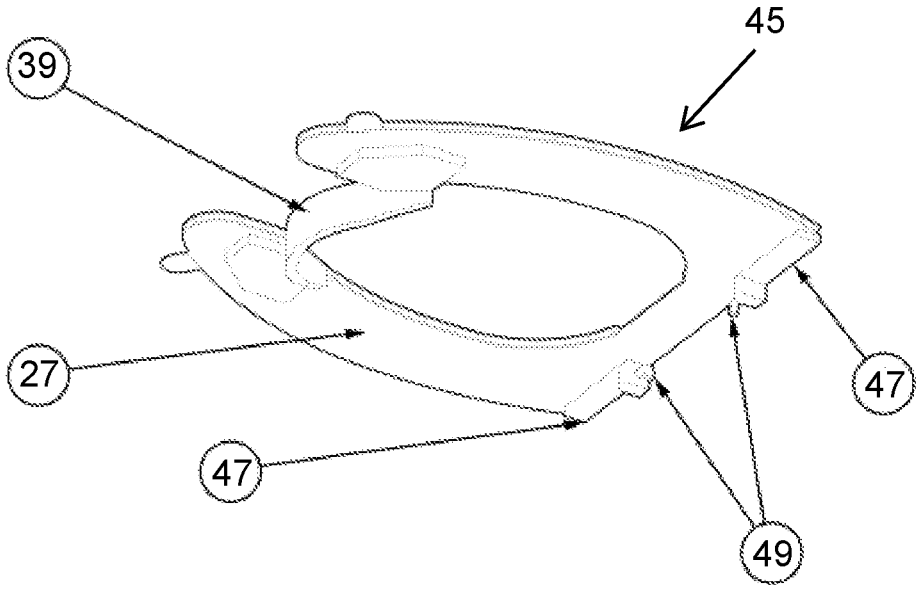
FIG. 9 is a perspective view from the bottom of the toilet seat of FIG. 8.

FIGS. 8 and 9 illustrate a hygienic toilet accessory, generally indicated as 40, according to another embodiment. Accessory 40 comprises a dedicated toilet seat 45 configured with the previously described upper layer 26 and lower layer 27 and which is pivotally connected to a toilet bowl assembly with two hinge assemblies 47 and corresponding metal bolts 49 that are capable of being coupled to the toilet bowl assembly. Each hinge assembly 47 is provided at the underside of lower layer 27 and substantially in alignment with proximal region 31. Dedicated toilet seat 45 may be configured with two lifting tabs 37 and urine shield 39.

Figure 10:
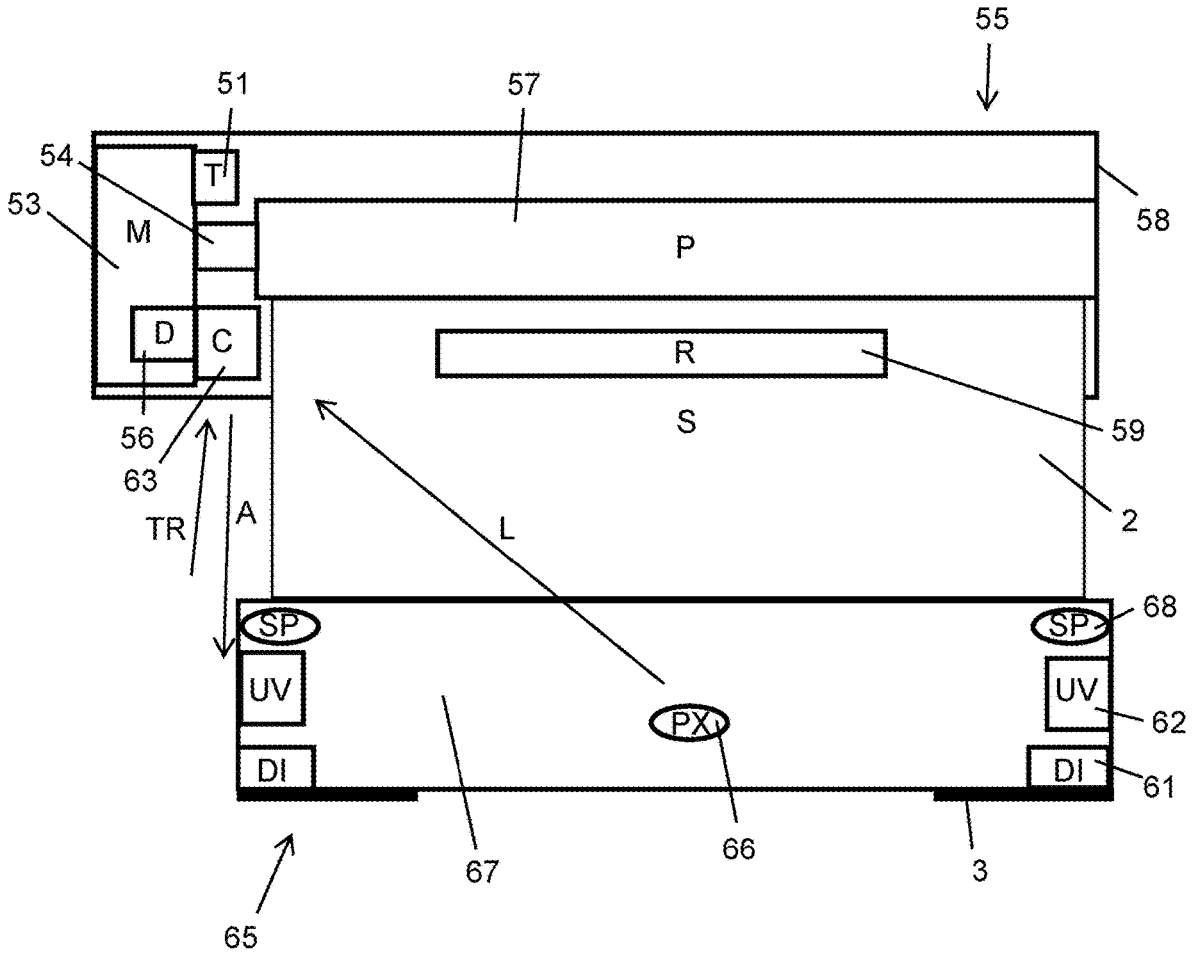
FIG. 10 is a schematic illustration of another embodiment of a housing member and of a sanitization assembly.

In another embodiment as schematically illustrated in FIG. 10, housing member 55 comprises means for automatically displacing the toilet isolating sheet and automatically sanitizing a toilet seat, or only means for automatically displacing the toilet isolating sheet. The automatic displacing means is configured to set the toilet isolating sheet to a default fully extended position, as a reminder to users accessing the corresponding toilet to maintain hygienic conditions. Housing member 55 may cooperate with any toilet seat described herein.

Housing member 55 may comprise a motorized post 57 about which the sheet 2 is wound and to which the sheet is connected. The stator of a small motor 53 is mounted within housing 55 at one longitudinal end thereof, and the drive shaft 54 of motor 53 is connected to a corresponding longitudinal end of post 57. The other longitudinal end of post 57 is rotatably mounted within the inner face 58 of the other longitudinal end of housing member 55. Sheet 2 is extended when post 57 is rotated in one direction, and is retracted when post 57 is rotated in the other direction. A tensioning roller 59 may be provided within housing 55 to ensure tautness of the sheet when being extended or retracted.

A processor based communication module 63 is electrically connected to the driver 56 of motor 53, whether wirelessly or through a wired connection, and is adapted to automatically activate the motor to retract sheet 2 from the default extended position upon receiving a trigger signal TR and to subsequently return the sheet to the fully extended position. Motor 53, upon being activated, may operate for a predetermined duration in conjunction with a timer 51 that is suitable for causing a fully extended sheet to become retracted, or vice versa. Communication module 63 may be configured with an antenna, transceiver or other means well known to those skilled in the art for communicating a wireless signal.

When sheet 2 is extended from housing 55, while being extended and retracted, or alternatively only being extended or only being retracted, an ultraviolet light (UV) unit 62 mounted at each end of sanitization assembly 65 may be activated to emit an UV light having a wavelength and intensity that are suitable to sanitize the upper layer of the toilet seat over which sanitation assembly 65 is being displaced by reducing harmful germs and bacteria found thereon. According to a recent study conducted by the FDA, UV light is capable of quickly destroying the outer protein coating of the coronavirus and to thereby inactivate its effectiveness. It is likewise foreseen that the UV light is capable of destroying the outer protein coating of other types of virus.

An attachment element is attached between the distal edge of sheet 2 and sanitization assembly 65, and is configured with a sufficient height to allow each UV unit 62 to be in range of the toilet seat. Communication module 63 is configured to transmit an activation signal A to each UV unit 62 during operation of motor 53 and the resulting displacement of sheet 2. Sheet 2 is caused to be linearly displaced by motor 53 at a rate that ensures sufficient exposure to the UV light for destroying and deactivating various kinds of pathogens such as viruses including coronavirus and bacteria located on the toilet seat. The significant manpower for manually manipulating a UV sanitizer with respect to all toilet seats of a public facility is advantageously eliminated with the automatic sanitization assembly 65.

Sanitization assembly 65 may also be configured with a replaceable sponge 68 that is adapted to be in resilient contact with the upper layer of the toilet seat, or with any other suitable drying means well known to those skilled in the art. Sponge 68, which is spaced from a corresponding UV unit 62, is therefore able to absorb and dry any liquids located on the upper layer of the toilet seat during linear displacement of sanitization assembly 65. It will be appreciated that wiper assembly 8 of FIG. 1 may also be configured with replaceable sponge 68 or with any other suitable drying means. Communication module 63 may synchronize operation of each UV unit 62 with motor 53 such that the UV light will be illuminated only when sheet 2 is being retracted, to ensure that the UV light will be irradiated on a dry toilet seat and will therefore perform an effective sanitization operation.

Sanitization assembly 65 may also be configured with a wiper 3 and a liquid cleaning agent dispenser 61 associated with each arm 67 of the sanitization assembly and separated from a corresponding UV unit 62. Liquid cleaning agent dispenser 61 may be a manual dispenser whereby the cleaning agent is dispensed through a dedicated aperture in response to linear displacement. Alternatively, dispenser 61 may be electrically actuated in response to an activation signal A transmitted by communication module 63. Wiper 3 is adapted to apply the cleaning agent onto the toilet seat after having been dispensed from the dedicated aperture.

Thus sanitization assembly 65 may be configured with one or more of the sanitization means that includes for example liquid cleaning agent dispenser 61, UV unit 62 and sponge 68. When at least two of these means are provided, their relative position is selected in such a way so as not to interfere with one another. An activation signal A may be transmitted to two of these means with a timed delay provided by timer 51 or in response to a known number of motor rotor rotations.

Sanitization assembly 65 may be configured with a proximity sensor 66, which may be mounted for example on attachment element 31 or tab 5 (FIG. 7) and is in data communication with communication module 63, such as through a Wifi network or a short-range transmitter. Proximity sensor 66 disables the default operation of motor 53 to cause extension of sheet 2 when an object is detected within a predetermined proximity, e.g. 2 cm. Accordingly, proximity sensor 66 will transmit a detect signal L to communication module 63 when a user is sitting on the toilet seat, to prevent the user from being contacted by sanitization assembly 65. When the user stands afterwards, an object is no longer detected within the predetermined proximity and motor 53 is operated to cause extension of sheet 2 to an extreme position and to sanitize the toilet seat.

Figure 11:
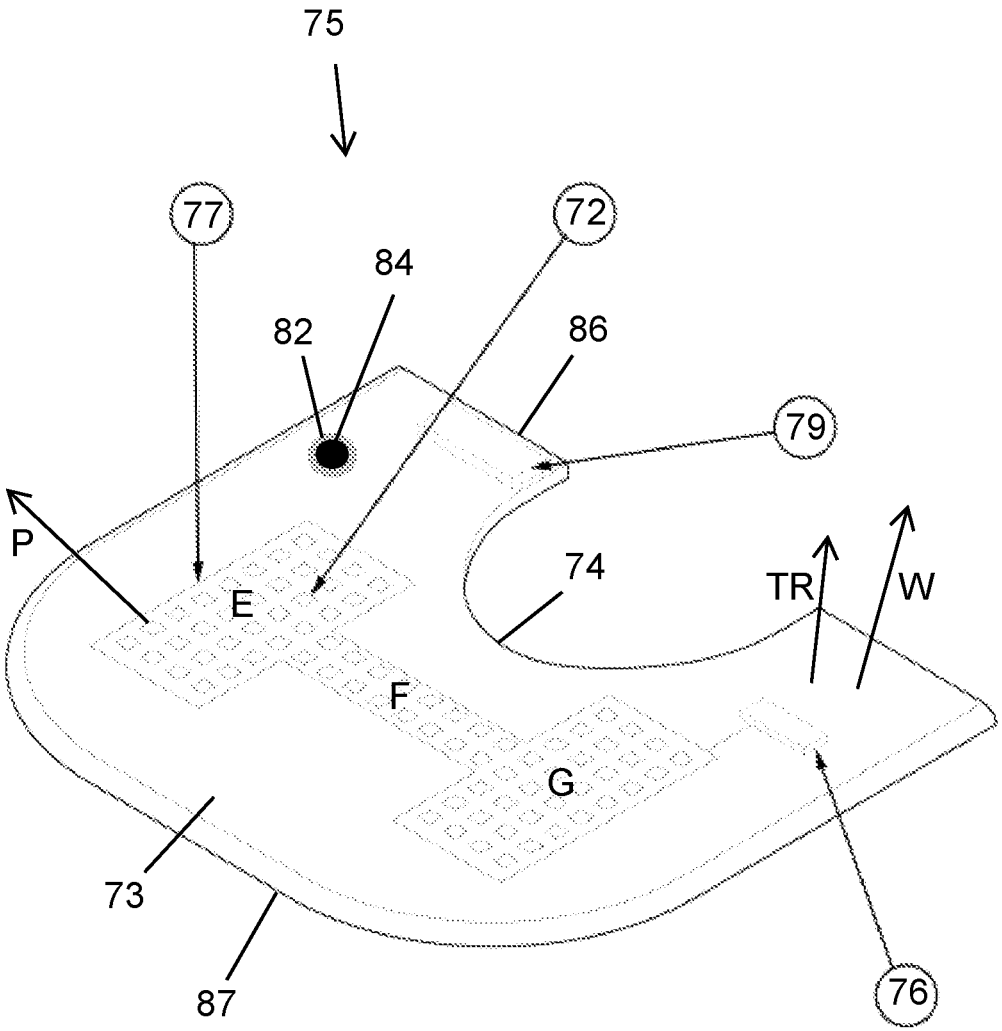
FIG. 11 is a schematic perspective view from the top of a smart mat configured to be in data communication with a module of the housing member of FIG. 10.

One trigger for the communication module may be the smart mat 75 shown in FIG. 11. Upon determining the presence of a user on smart mat 75, which is located in the surroundings of the existing toilet, a trigger signal TR is transmitted from smart mat 75 to the communication module, causing the toilet isolating sheet to be retracted from the default extended position.

Smart mat 75 comprises an array of sensors 72, generally pressure sensitive sensors, which are embedded in at least one polymeric layer 73, generally configured with clearly defined and spaced first 86 and second 87 edges. Polymeric layer 73 may be shaped with a concave edge 74, which is cut out from first edge 86 and adapted to abut the toilet bowl base.

The array of sensors 72, which are electrically connected to an embedded short-range transmitter 76 in data communication with the communication module of the cylindrical housing, may be configured as a visible H-shaped array 77, to help guide the user where to place his or her feet. H-shaped array 77 may have distinctive spaced foot-positionable regions E and F and interconnecting region G. A removably embedded rechargeable battery 79, e.g. a lithium battery, or a wired connection to a power source such as the electricity grid is used to power sensors 72 and transmitter 76.

The processor of the communication module may be configured to process the pressure indicative signal P transmitted by each sensor 72 upon being stepped upon by a user, to determine whether the front or the back of the user is facing the toilet. One way of determining the facing direction of the user is by comparing the pressure applied by different areas of a foot of the user. Since the heel generally applies a greater pressure than the sole of the same foot of a user, the determination of a pressure distribution in a foot that has stepped on foot-positionable regions E and F can help determine the facing direction of the user. That is, the processor is able to determine that the front of the user is facing the toilet when relatively high foot pressure is localized closer to second mat edge 87 and relatively low foot pressure is localized closer to first mat edge 86. Conversely, the processor is able to determine that the back of the user is facing the toilet when relatively high foot pressure is localized closer to first mat edge 86 and relatively low foot pressure is localized closer to second mat edge 87.

An air freshener 82, generally replaceable, may also be embedded in smart mat 75, so as to be actuated by an actuator 84, when stepped upon by a user. Actuator 84 may be an electrical actuator in electrical connection with the array of sensors 72 or a mechanical actuator separate from the sensor array. This arrangement maintains an ongoing fragrance emission from the mat. The electrical actuator may be in electrical communication with short-range transmitter 76, to cause transmission of a warning signal W to the communication module to indicate that that an air freshener container, such in cartridge form, needs to be replaced. An audible signal device provided with the communication module may emit a distinctive sound upon receiving warning signal W.

The communication module may also be responsive to a trigger signal transmitted by other types of signal-transmittable equipment, such as a motion sensor, a bathroom mounted or toilet mounted hand-pressable button, a bathroom mounted or toilet mounted foot-pressable pedal, and a voice detector.

Figure 12:
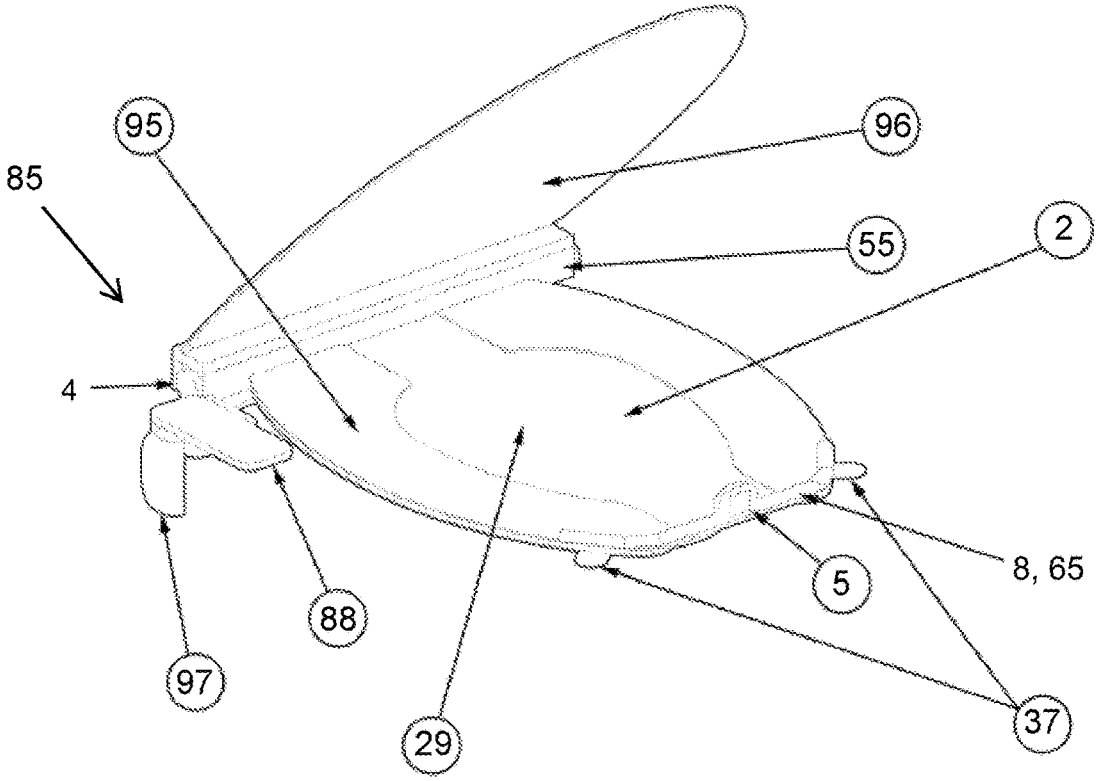
FIG. 12 is a perspective view from the top of a smart toilet unit incorporating the housing member of FIG. 10.
Figure 13:
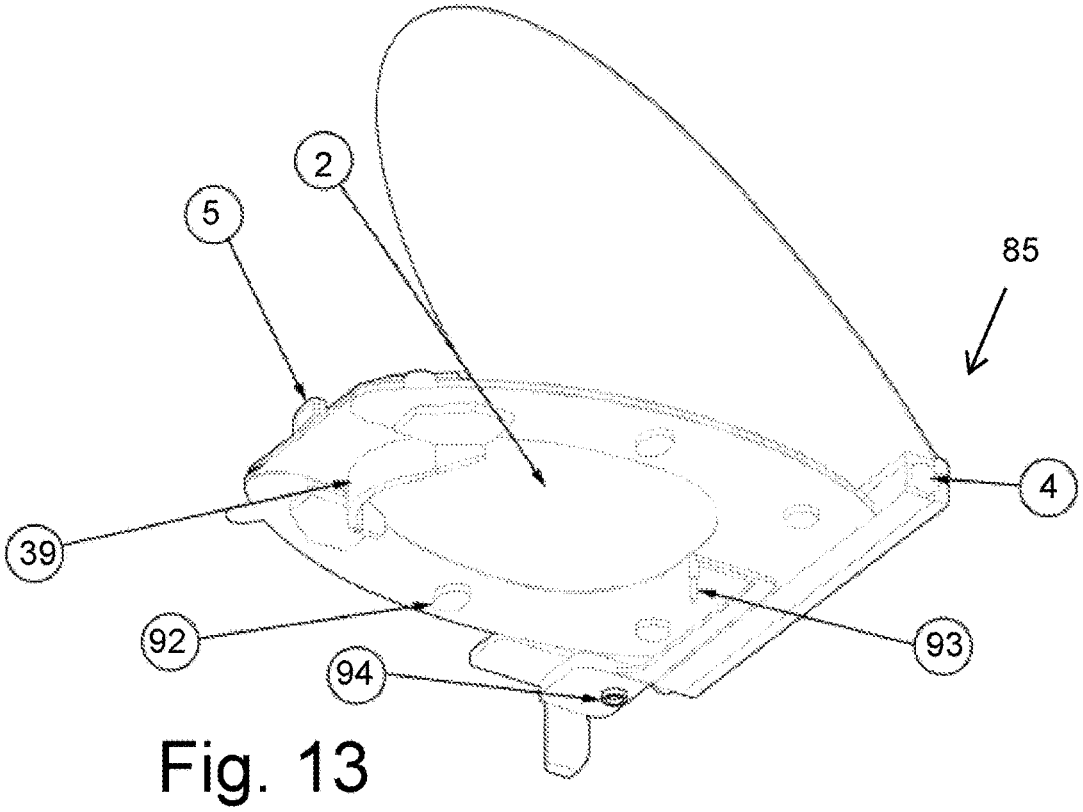
FIG. 13 is a perspective view from the bottom of the smart toilet unit of FIG. 12.

Housing member 55 provided with communication module 63 (FIG. 10) is well suited to be interfaced with an exemplary smart toilet unit 85 shown in FIGS. 12 and 13.

Housing member 55 is in abutting relation with toilet seat 95, which is configured similarly to toilet seat 45 of FIG. 8, but with some modifications intended to cooperate with smart toilet unit 85, such as bidet 93 and bidet hose attachment 94 operatively connected to the underside of the bottom layer of toilet seat 95 and operated by means of remote control unit 88 positioned to the side of housing member 55, possibly attached to the toilet tank. An air freshener housing 97 containing one or more replaceable cartridges may be positioned below remote control unit 88. A plurality of raisers 92 may extend downwardly from the bottom layer of toilet seat 95. One or both of a self-lifting and self-lowering automatic toilet seat 95 and automatic lid 96 may be pivotally connected to housing member 55. The operation of bidet 93, automatic toilet seat 95 and automatic lid 96 may be controlled by communication module 63 or by a different controller.

Either wiper assembly 8, as shown, or sanitization assembly 65 (FIG. 10) may be attached to the distal edge of toilet isolating sheet 2, and be linear displaced unrestrictedly along passageway 29.

Figure 14:
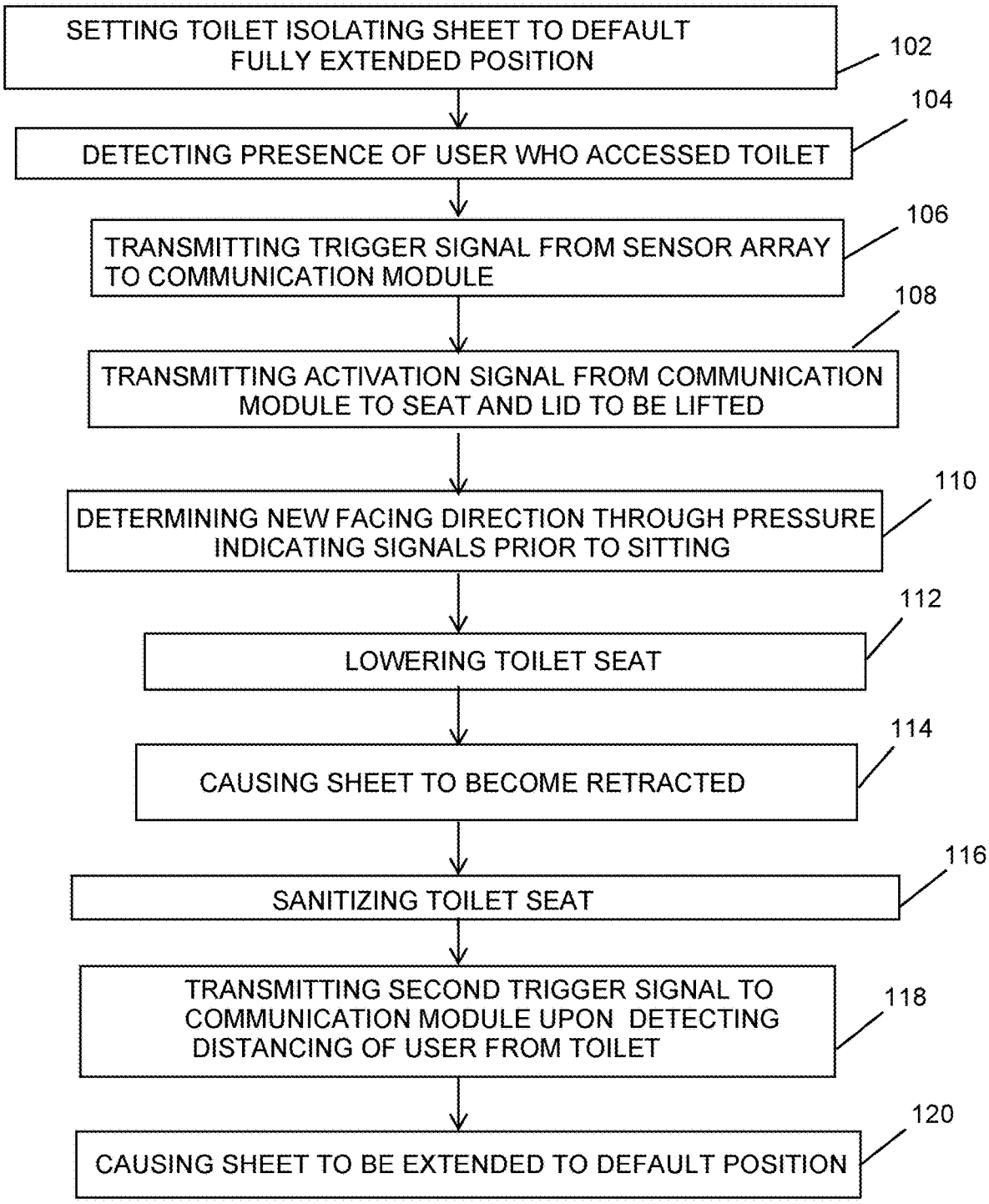
FIG. 14 is one embodiment of a hands-free and sanitizing-promoting toilet-interfacing method.

A hands-free and sanitizing-promoting toilet-interfacing method in conjunction with the automatic sheet displacing means of FIG. 10, smart toilet unit 85 of FIG. 12 and smart mat 75 of FIG. 11 is illustrated in FIG. 14. Similar methods are envisioned mutatis mutandis when the trigger signal is generated in other ways.

With the toilet isolating sheet configured to be set in the default fully extended position that completely covers the toilet opening in step 102, the signal-generating array of sensors detects the presence of a user who has accessed a toilet in step 104. In response, a trigger signal is transmitted in step 106 from the sensor array to the communication module, and an activation signal is transmitted in turn in step 108 from the communication module to the toilet seat and lid so that they will be both automatically lifted. If the user decides to sit down on the toilet seat, the communication module determines the new facing direction of the user in step 110 after the sensor array of the smart mat has transmitted corresponding pressure indicative signals and causes the automatic toilet seat to be lowered in step 112. Afterwards, or simultaneously with the lowering of the toilet seat, the sheet displacing motor is activated in step 114 to cause the sheet to become retracted and the sanitization assembly which is attached to a distal region of the sheet to sanitize the underlying toilet seat in step 116. A second triggering signal is transmitted to the communication module in step 118 after the sensor array detects that the feet of user have ceased to apply pressure to indicate that the user is distanced from the toilet, whereupon the motor is activated in step 120 to cause the sheet to be fully extended to the default position and to once isolate the toilet.

It will be appreciated that this method may be performed mutatis mutandis without use of a sheet such that the sanitization assembly will be activated by suitable means following transmission of a trigger signal or pressure indicative signals. Likewise another automatic hands-free toilet-interfacing method may be performed, such as an automatic flushing operation, with cooperation of smart toilet unit 85 and smart mat 75.

Figure 15:
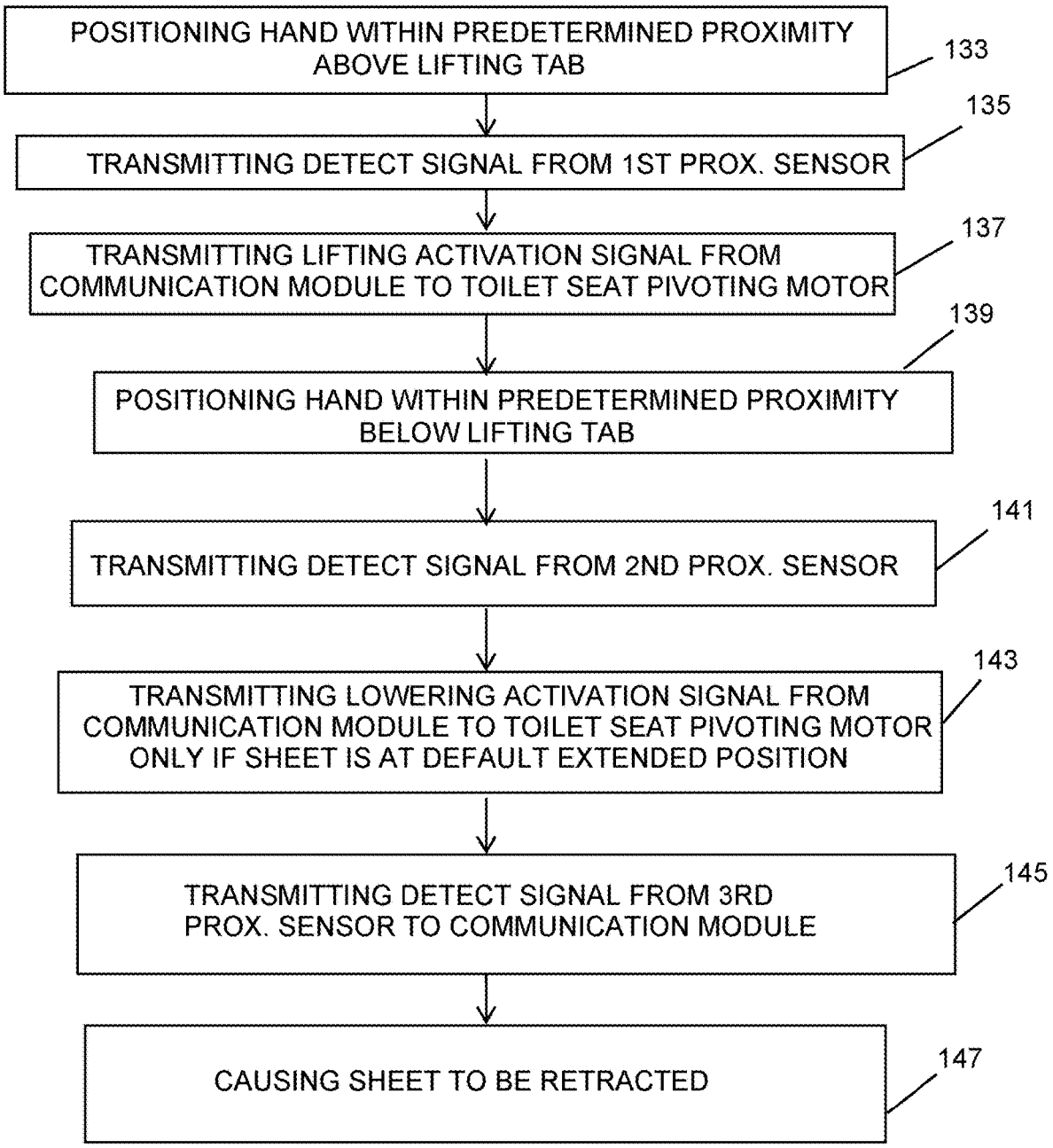
FIG. 15 is another embodiment of a hands-free and sanitizing-promoting toilet-interfacing method.

Another embodiment of a hands-free and sanitizing-promoting toilet-interfacing method is illustrated in FIG. 15.

In this embodiment, any one of the toilet seats described herein is additionally equipped with smart lifting tabs. That is, each of the lifting tabs 37 (for example shown in FIG. 8) is configured with two proximity sensors that are in data communication with the communication module provided with housing member 55 of FIG. 10, or any other suitable communication module, that initiates operation of an automatic toilet seat and/or an automatic toilet lid, such as smart toilet unit 85 of FIG. 12. A first proximity sensor is accessible at an upper surface of each lifting tab, and a second proximity sensor is accessible at a lower surface of the lifting tab. Another motor, in addition to the sheet displacing motor, for initiating operation of an automatic toilet seat and/or an automatic toilet lid may be provided within housing member 55. A third proximity sensor, similar to proximity sensor 66 shown in FIG. 10, is additional provided, and is mounted on the sanitization assembly, preferably at a central region thereof.

Rather than manually contacting the germ laden lifting tabs of the prior art in order to lift and lower a toilet seat, a user conveniently accesses a toilet and positions his or her hand within a predetermined proximity above one the lifting tabs in step 133, without being physically contacted. The first proximity sensor transmits a detect signal to the communication module in step 135, whereupon the latter transmits an activation signal to the toilet seat pivoting motor in step 137 to lift the toilet seat and, generally, to lift the toilet lid as well. After operation of the toilet seat pivoting motor, the state of the toilet seat is updated in a buffer to a lifted state. When the hand of the user is positioned within the predetermined proximity below one of the lifting tabs in step 139, without being physically contacted, the second proximity sensor transmits a detect signal to the communication module in step 141. The communication module transmits an activation signal to the toilet seat pivoting motor in step 143 to lower the toilet seat only if the sheet is positioned at the default extended position. After operation of the toilet seat pivoting motor, the state of the toilet seat is updated in a buffer to a lowered state.

If for some reason, an object, such as a user's hand or back, is located within a predetermined proximity to the third proximity sensor, the third proximity sensor transmits a detection signal to the communication module, which in turn activates the sheet displacing motor to cause retraction of the sheet. When the detection signal generated by the third proximity sensor is terminated following separation of the previously positioned object therefrom, the communication module is programmed to automatically activate the sheet displacing motor to cause extension of the sheet to its default fully extended position. The communication module will therefore disable transmission of the activation signal to the toilet seat pivoting motor if it previously received a detection signal from the third proximity sensor.

When the user sits on the lowered toilet seat, the third proximity sensor detects the presence of the user in step 145 and causes the sheet to become retracted in step 147.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A hygienic toilet accessory, comprising:

a) a hollow housing member which is attachable to a toilet related element and which is configured with an elongated slit;

b) a toilet isolating sheet which is intermittently extendable through and retractable into said slit, said sheet dimensioned to completely cover a central opening of a toilet seat when extended to an extreme position and to prevent discharge of aerosols from the toilet underlying therebelow; and c) a sanitization assembly attached to a distal region of said sheet, said sanitization assembly comprising means for automatically sanitizing the toilet seat during extension or retraction of the sheet, or during extension and retraction of the sheet.

2. The accessory according to claim 1, further comprising a toilet seat configured with vertically spaced and aligned upper and lower layers to define therebetween an interspace within which the sheet is guidable to the extreme position at a distal region of said toilet seat, wherein each of said upper and lower layers is formed with the central opening, and wherein said upper and lower layers are completely unattached at an inner edge thereof adjoining the central opening to accommodate linear displacement of the sheet.

3. The accessory according to claim 2, wherein the toilet seat is a clip-on toilet seat.

4. The accessory according to claim 2, wherein a proximal edge of the upper and lower layers is positioned sufficiently close to the housing member to ensure that the sheet will be reliably introduced into the interspace when being extended.

5. The accessory according to claim 4, wherein the proximal edge of the upper and lower layers is attached to, or is integrally formed with, the housing member.

6. The accessory according to claim 2, wherein the sanitization assembly is positioned above the upper layer of the toilet seat throughout extension and retraction of the sheet, to ensure sanitization of the upper layer.

7. The accessory according to claim 6, wherein a vertically oriented attachment element capable of being displaced uninhibitedly through the central opening of the toilet seat is attached to a central region of the distal region of the sheet and to the sanitization assembly such that the sanitization assembly is vertically separated from the sheet by a distance greater than or equal to a thickness of the upper layer of the toilet seat.

8. The accessory according to claim 7, wherein the sanitization assembly comprises a wiper assembly in movable engagement with the upper layer of the toilet seat.

9. The accessory according to claim 8, wherein the sanitization assembly further comprises a liquid cleaning agent dispenser by which the cleaning agent is automatically dispensable through a dedicated aperture and a wiper of the wiper assembly is adapted to apply the dispensed cleaning agent onto the toilet seat.

10. The accessory according to claim 9, wherein a tab protruding vertically from the attachment element facilitates guiding the sheet during extension or retraction and the cleaning agent is automatically dispensable in response to linear displacement of the wiper assembly.

11. The accessory according to claim 9, wherein the dispenser is electrically actuated.

12. The accessory according to claim 8, wherein the sanitization assembly further comprises a replaceable sponge adapted to be in resilient contact with the upper layer of the toilet seat.

13. The accessory according to claim 7, wherein the sanitization assembly comprises a UV unit configured to emit an ultraviolet light suitable to sanitize the upper layer of the toilet seat.

14. The accessory according to claim 13, wherein the sanitization assembly further comprises drying means ensuring that the ultraviolet light will be irradiated on a dry toilet seat.

15. The accessory according to claim 13, wherein the sanitization assembly further comprises a liquid cleaning agent dispenser by which the cleaning agent is automatically dispensable through a dedicated aperture and a wiper in movable engagement with the upper layer of the toilet seat adapted to apply the dispensed cleaning agent onto the toilet seat.

16. The accessory according to claim 1, further comprising means for automatically displacing the toilet isolating sheet.

17. The accessory according to claim 16, wherein the automatic displacing means is configured to set the toilet isolating sheet to a default fully extended position.

18. The accessory according to claim 17, wherein the automatic displacing means is spring loaded and is configured to extend the sheet outwardly through the elongated slit after being momentarily retracted.

19. The accessory according to claim 16, wherein the automatic displacing means comprises a post about which the sheet is wound and a motor for rotatably driving said post.

20. The accessory according to claim 19, wherein the automatic displacing means further comprises a processor based communication module electrically connected to a driver of the motor and adapted to automatically activate the motor upon receiving a trigger signal.

21. The accessory according to claim 20, wherein the communication module is adapted to automatically activate the motor to cause the sheet to retract from the default fully extended position upon receiving the trigger signal which is indicative of a presence of a user who has accessed a toilet.

22. The accessory according to claim 21, wherein the communication module is responsive to the trigger signal generated by a mat in which is embedded an array of pressure sensitive sensors.

23. The accessory according to claim 21, wherein the communication module is responsive to the trigger signal generated by signal-transmittable equipment selected from the group consisting of a motion sensor, a bathroom mounted hand-pressable button, a toilet mounted hand-pressable button, a bathroom mounted foot-pressable pedal, a toilet mounted foot-pressable pedal, and a voice detector.

24. The accessory according to claim 20, wherein the communication module is adapted to automatically activate the motor to cause the sheet to become extended upon receiving the trigger signal.

25. The accessory according to claim 24, further comprising a proximity sensor provided with the sanitization assembly and in data communication with the communication module, wherein the proximity sensor is configured to transmit a detect signal constituting the trigger signal to the communication module when the sheet is retracted and a user is sitting on the toilet seat and is within a predetermined proximity of the proximity sensor, and the communication module is configured to disable the motor is response to receiving the detect signal.

26. The accessory according to claim 1, wherein the toilet isolating sheet is configured to be used as an advertising space and is configured with one or more exterior protective layers that are transparent or translucent to facilitate reuse of the sheet without deterioration.

27. The accessory according to claim 2, wherein the toilet seat is configured with one or more lifting tabs extending from an outer edge of the toilet seat and configured to assist in lifting and lowering the toilet seat.

28. The accessory according to claim 27, further comprising a toilet seat pivoting motor, wherein each of the lifting tabs comprises first and second proximity sensors that are accessible at upper and lower surfaces, respectively, of the lifting tab, wherein said toilet seat pivoting motor and said first and second proximity sensors are in data communication with the communication module, an activation signal being transmittable from the communication module to said toilet seat pivoting motor to lift the toilet seat following transmission of a detect signal from said first proximity sensor to the communication module that is indicative that a hand has been positioned within a predetermined proximity from said first proximity sensor without being physically contacted.

29. The accessory according to claim 20, wherein the toilet seat is a self-lifting and self-lowering automatic toilet seat.

30. The accessory according to claim 29, wherein the toilet seat cooperates with a bidet and bidet hose attachment operatively connected to an underside of the lower layer of the toilet seat.

31. The accessory according to claim 30, wherein the communication module is operable to control operation of one or more of the automatic toilet seat, the bidet and the bidet hose attachment.

32. The accessory according to claim 30, further comprising a remote control unit for selectively operating the bidet and bidet hose attachment.

33. A method for sanitizing a toilet seat, comprising the steps of:

a) providing a motor driven post about which is wound a toilet isolating sheet and a sanitization assembly attached to a distal region of said sheet;

b) detecting, by signal generating detection apparatus, presence of a user who has accessed a toilet;

c) in response to said detected presence, transmitting a trigger signal from said detection apparatus to a communication module in data communication with a driver of said motor; and d) activating said motor in response to transmission of said trigger signal, to cause said sheet to be linearly displaced relative to a toilet seat and said sanitization assembly to automatically sanitize a portion of the toilet seat underlying said sanitization assembly.

34. The accessory according to claim 22, further comprising a toilet-interfacing component in data communication with the communication module, wherein the communication module is additionally configured to process a signal transmitted by each of the pressure sensitive sensors to determine whether a front or a back of a user is facing a toilet upon stepping on the mat, and to activate said component following determination of a toilet facing position of the user.

* * * * *